United States Patent [19]

Zanardi et al.

[11] Patent Number: 5,004,412

[45] Date of Patent: Apr. 2, 1991

[54] GEAR MACHINE FOR USE AS A PUMP OR MOTOR

[75] Inventors: Angelo Zanardi, Corticella; Daniele Mei, Bologna; Vittorio Toselli, Pianoro, all of Italy

[73] Assignee: Sauer-Sundstrand S.p.A., Via Villanova, Italy

[21] Appl. No.: 417,729

[22] Filed: Oct. 5, 1989

[30] Foreign Application Priority Data

Aug. 4, 1988 [IT] Italy ..... 3408 A/88

[51] Int. Cl.[5] ..... F04C 15/00

[52] U.S. Cl. ..... 418/132

[58] Field of Search ..... 418/39, 132

[56] References Cited

U.S. PATENT DOCUMENTS

| | | | |
|---|---|---|---|
| 2,842,066 | 7/1958 | Hilton . | |
| 3,578,887 | 5/1971 | Turolla | 418/132 |
| 3,748,063 | 7/1973 | Putnam | 418/132 |
| 3,895,890 | 7/1975 | Laumont | 418/132 |
| 3,975,124 | 8/1976 | Dworak et al. | 418/132 |
| 4,108,582 | 8/1978 | Bitton | 418/132 |
| 4,281,974 | 8/1981 | Teruyama | 418/132 |
| 4,392,798 | 7/1983 | Bowden | 418/132 X |
| 4,465,444 | 8/1984 | Dworak et al. | 418/132 |
| 4,527,966 | 7/1985 | Laumont | 418/132 |

FOREIGN PATENT DOCUMENTS

| | | |
|---|---|---|
| 1426585 | 12/1965 | France . |
| 1533849 | 6/1968 | France . |
| 1551320 | 11/1968 | France . |
| 2246188 | 12/1973 | France . |
| 2212861 | 7/1974 | France . |
| 769763 | 3/1957 | United Kingdom . |

*Primary Examiner*—Leonard E. Smith

*Attorney, Agent, or Firm*—Michael N. Meller

[57] ABSTRACT

A gear machine includes a machine casing closed by two covers and within which two gear wheels provided on respective shafts supported by bushes are in mutual engagement. A compensation area for the axial thrusts to which a bush is subjected is defined between an elastic diaphragm installed between the bush and a cover, so that because of the clearance between the gear wheels and bushes rapid starting is possible even under load, whereas as pressure increases a corresponding flexure of the diaphragm towards the bushes occurs, so as to gradually narrow clearance while at the same time partially balancing the axial thrusts.

16 Claims, 3 Drawing Sheets

GEAR MACHINE FOR USE AS A PUMP OR MOTOR

BACKGROUND OF THE INVENTION

This invention relates to a gear machine for use as a pump or motor.

Current gear machines are known to comprise a machine casing closed as it axial ends by respective covers and internally housing two mutually engaging gear wheels. The gear wheels are provided on two rotatable shafts, namely the drive and drive shaft, which are supported by two bushes substantially of "8" shape. Gear machines of the compensation type and of the fixed clearance type are in use. In compensated machines, seal gaskets are installed between the bushes and covers to define a space which is hydraulically connected to that part of the machine through which high-pressure fluid flows. During operation, axial thrusts are created along the clearance walls defined between the gear wheel sides and the bushes and act on the latter, to be compensated by the axial thrusts created between the covers and the space defined by the gaskets. The gaskets are preloaded during machine assembly to compensate for the gap between the gear wheels and bushes. A gear machine of the compensation type therefore allows the gap along the clearance walls to be narrowed allows the axial thrusts which arise along the clearance walls to be balanced, and results in high volumetric efficiency for pumps and high mechanical efficiency for motors. However, the machine has certain drawbacks due to the gasket preloading. In this respect, the preloading tends to urge the bushes towards the gear wheels so that on starting the machine there can be considerable friction between the bushes and gear wheels. For operation as a pump, the machine must be connected to a motor (normally electric) which has to overcome this initial separation friction and must therefore have a high starting torque. Consequently a powerful motor must be connected to the pump. It is apparent that the greater the motor power, the higher its cost. For operation as a motor, the machine must be connected to a pump able to feed fluid at high pressure both to overcome that friction and to overcome the initial load provided by the user device connected to the motor. Likewise, a powerful and therefore more costly pump has to be installed. In machines of the compensation type, the greatest inconvenience occurs therefore on starting, by virtue of the friction existing along the clearance walls.

In fixed clearance machines there is no compensation as no seal gaskets are provided along the spaces between the bushes and covers into which the high pressure fluid flows, so that in these machines there is no narrowing of the play existing along the clearance walls. The machine components are machined to give only a small clearance along the clearance walls. In spite of this, because of the axial thrusts which arise on the bushes during operation, the fluid seeps along these clearance walls. On the one hand, this is an advantage on starting because it results in low friction, but on the other hand it is also a serious drawback in that is considerably reduces machine efficiency. Moreover, because of the aforementioned machining, the machine is more costly and the device (pump or motor) upstream of the machine must be overdimensioned.

SUMMARY OF THE INVENTION

The object of the present invention is to provide a gear machine for use as a pump or motor which obviates the aforesaid drawbacks by operating as a fixed clearance machine on start-up, but as a compensation machine when under normal running of a predetermined fluid pressure.

This object is attained according to the present invention by a gear machine for use as a pump or motor of the type comprising a machine casing closed at each of its axial ends by a respective cover and internally housing two mutually engaging gear wheels provided on two rotatable shafts which are supported by two bushes one of which extends to the outside of the machine casing. Between at least one of the covers and the machine casing there is installed a relatively elastic diaphragm in which there is provided a first hydraulic communication between a zone of the machine casing traversed by a high-pressure fluid and a first space delimited between the cover and the diaphragm by a first preloaded gasket assembly and having an area substantially equal to that defined area on the bushes on which axial thrusts are present during operation, and a second hydraulic communication between a zone of the machine casing traversed by low-pressure fluid and a second space delimited between the cover and the diaphragm by a second gasket assembly. The preload of the first gasket assembly is insufficient to cause flexure of the diaphragm at the start of operation and thus is unable to influence the predetermined clearance existing between the bushes and gear wheels so that rapid starting is ensured even under load, whereas as fluid pressure increases, the fluid present in the first space causes corresponding flexure of the diaphragm towards the bushes so as to gradually compensate for the clearance.

BRIEF DESCRIPTION OF THE DRAWINGS

The present invention will be more apparent from the description of a preferred embodiment thereof given hereinafter by way of non-limiting example with reference to the accompanying drawings in which.

DETAILED DESCRIPTION OF THE INVENTION

Figure 1:
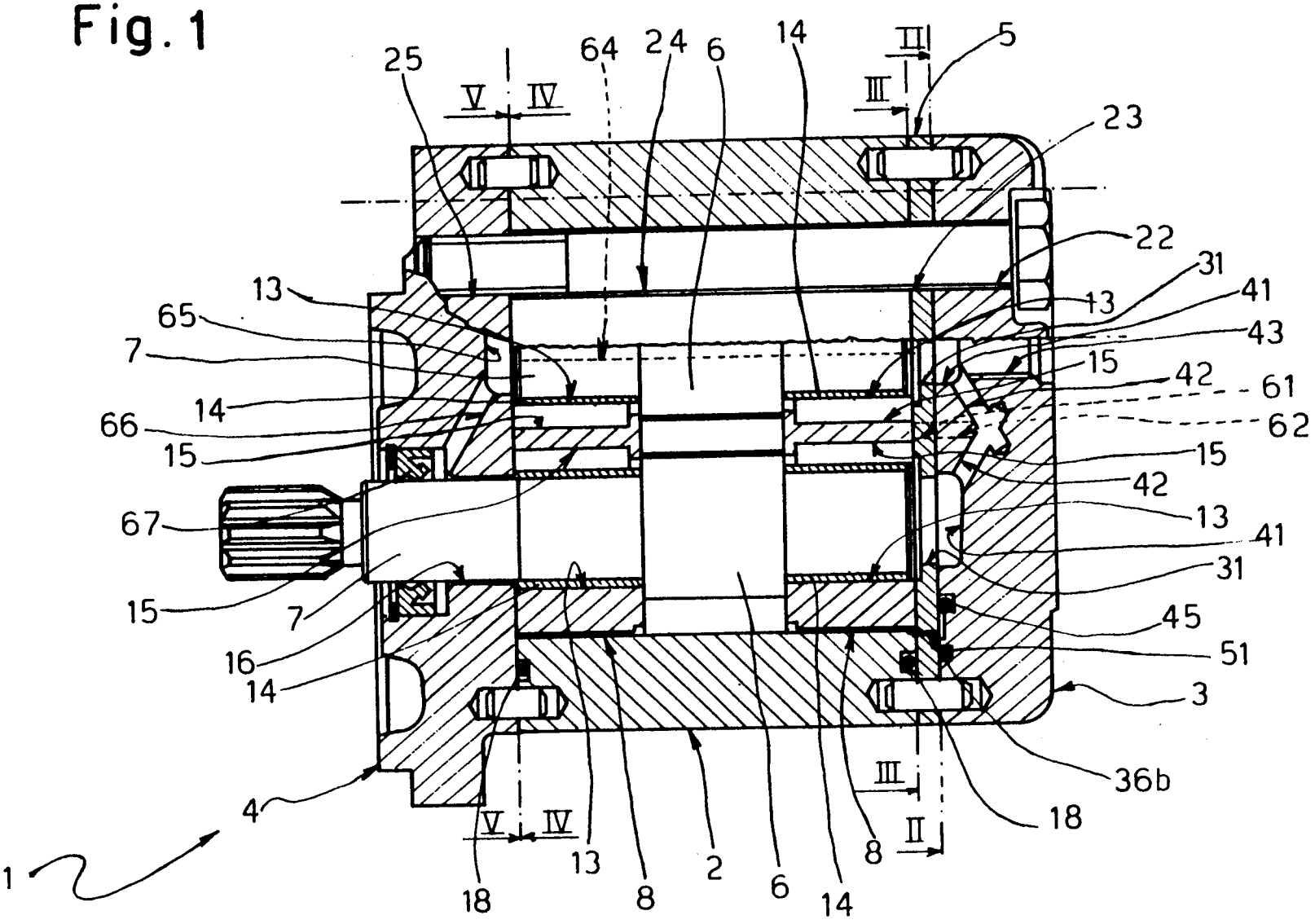
FIG. 1 is an axial sectional view through a gear machine constructed in accordance with the present invention.

In FIG. 1 the reference numeral 1 indicates overall a gear machine for use as a pump or motor. The machine 1 comprises a machine casing 2 closed at its axial ends by respective covers 3 and 4. A diaphragm 5 or relatively elastic material such as aluminum is mounted between the cover 3 and the corresponding axial end of the machine casing 2. As will be more apparent hereinafter, for determined pressures of the fluid flowing through the machine 1 the diaphragm 5 flexes towards the machine casing 2. Within the casing there act two mutually engaging gear wheels 6 provided on the central part of two rotatable shafts 7, one of which extends through the cover 4 to the outside of the machine casing 2. The shafts 7 are supported by two "8"-shaped bushes 8 which are also housed in the machine casing 2.

Figure 5:
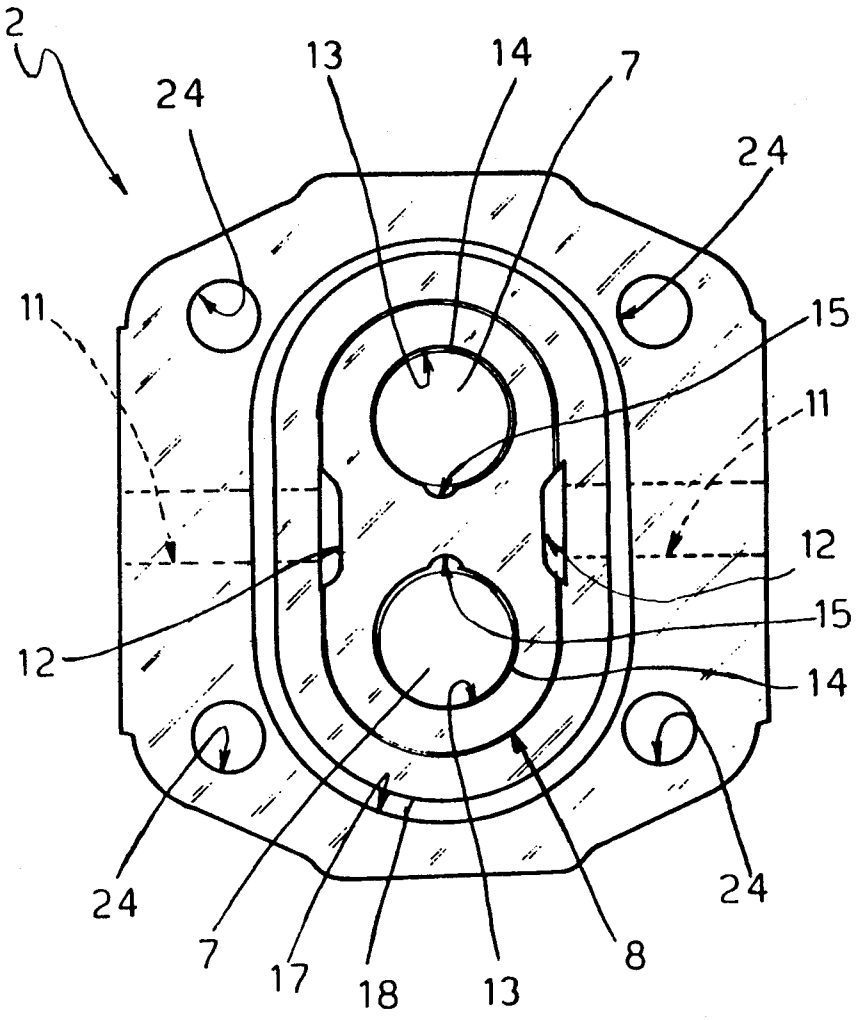

As shown in FIGS. 1 and 5, the machine casing 2 has an internal shape which reproduces the perimetral shape of the assembly formed from the two gear wheels 6. In the machine casing 2 in correspondence with the zone of engagement between the gear wheels 6 the casing 2 comprises on opposite sides two ports 11, namely an inlet port and outlet port. In correspondence with the ports 11 each bush 8 comprises cavities 12 which with the inner wall of the machine casing 2 define respective fluid channels. To support the shafts 7, each bush 8 comprises two parallel through holes 13, in each of which there is fitted a respective liner 14. Along the whole length of the holes 13 there is provided a recess 15, the purpose of which will be apparent hereinafter. One of the shafts 7 has substantially the same axial length as the machine casing 2, whereas the other extends through a hole 16 in the cover 4 to the outside of the machine 1 to be connected to an electric motor or a mechanical or electromechanical user device according to whether the machine 1 is used as a pump or motor. On each of the axial end faces of the machine casing 2 there is provided an annular seat 17 for a substantially elliptical retaining gasket 18. One gasket 18 makes contact with the inner face of the diaphragm 5 whereas the other makes contact with the inner face of the cover 4. The machine 1 is assembled by tightening down four screws 21, only one of which is shown in FIG. 1. The screws 21 pass successively through a hole 22 provided in the cover 3, a hole 23 provided in the diaphragm 5 and a hole 24 provided in the machine casing 2, and are then screwed into a threaded bore 25 provided in the cover 4. When assembled, the head of the screws 21 abuts against a shoulder formed in the hole 22.

Figure 3:
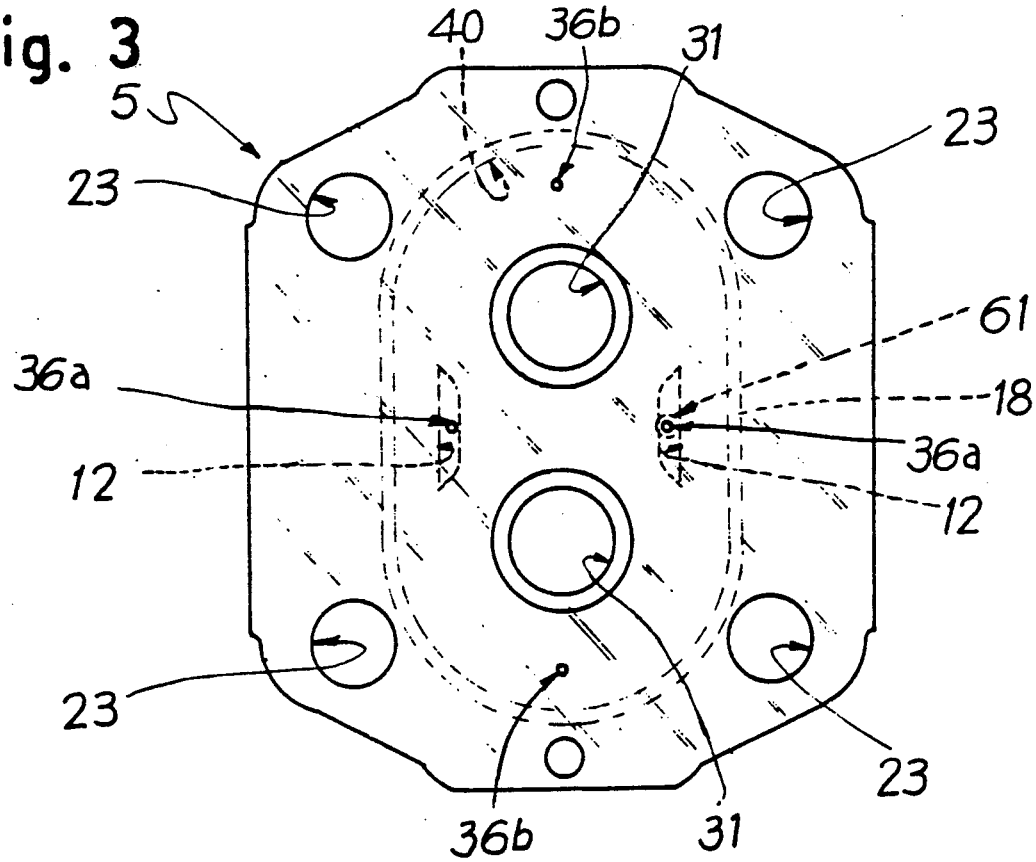

As shown in FIGS. 1 and 3, the diaphragm 5 comprises two through holes 31 which are coaxial with and face the holes 13 of the adjacent bush 8. As will be apparent hereinafter, a hydraulic seal is determined mechanically between the bush 8 and diaphragm 5 by the effect of the fluid pressure. In the diaphragm 5 there are also provided four small holes, two of which, indicated by 36*a*, are in line with the channels defined by the cavities 12, whereas the other two indicated by 36*b* are in line with the gap between the bush 8 and the inner wall of the machine casing 2. The first two holes 36*a* are symmetrical about a straight line orthogonal to that which joins the second two holes 36*b* and vice versa, as shown in FIG. 3.

Figure 2:
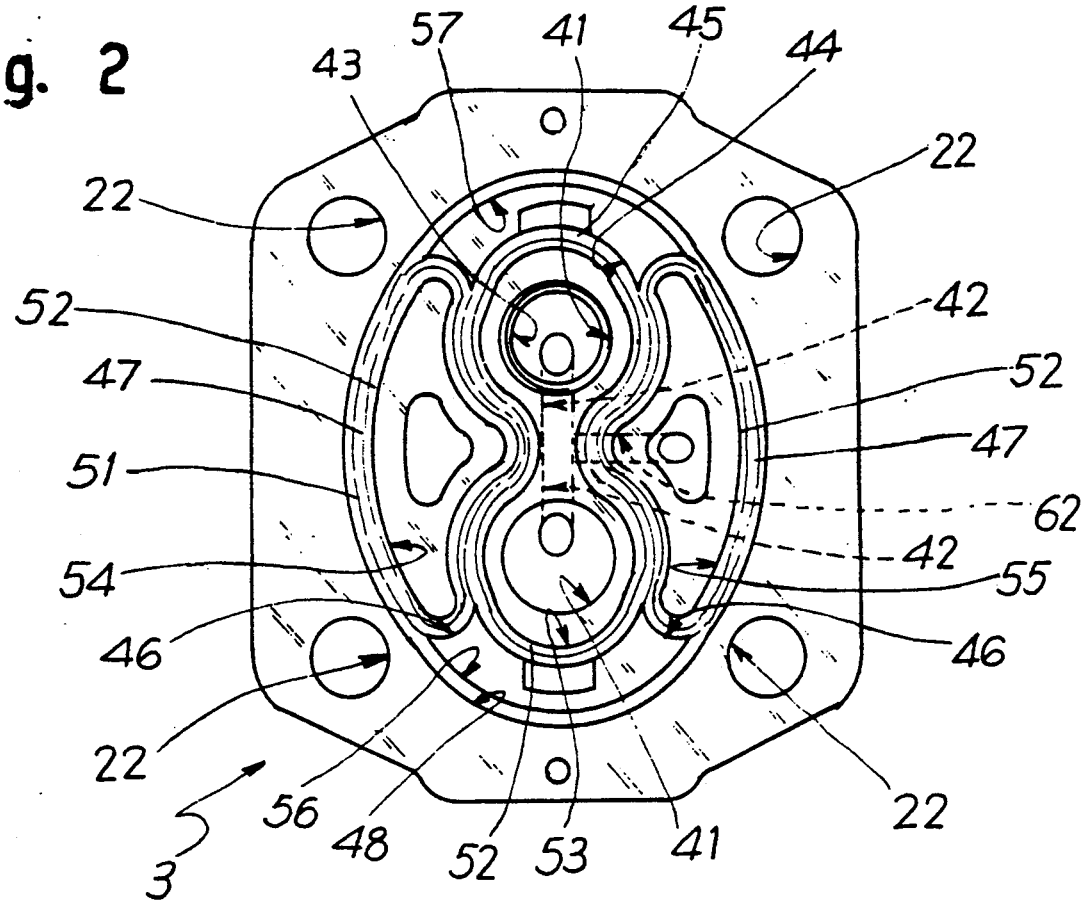
FIGS. 2, 3, 4 and 5 are sectional view taken along on the lines II—II, III—III, IV—IV and V—V of FIG. 1.

As shown in FIGS. 1 and 2, on the side facing the diaphragm 5, the cover 3 comprises two cylindrical recesses 41 coaxial with the holes 31 and communicating by way of two holes 42 which extend from the recesses 41 and intersect in the central part of the cover 3. A threaded bore 43 extends from the recess 41 coaxial to the shorter shaft 7, and into which, on operation as a motor, there is screwed one end of a discharge pipe for drainage reasons which will be apparent hereinafter. On operation as a pump, the bore 43 is engaged by a sealing plug. The space in which the recesses 41 are provided is delimited by an annular seat 44 housing a retaining gasket 45. The seat 44 and hence the gasket 45 are of "8" shape which substantially copies the perimetral shape of the bush 8. In correspondence with the cavities 12 provided in the bush 8 and reproduced in the gasket 45, in that face of the cover 3 facing the diaphragm 5 there are provided two opposing annular seats 46 for respective retaining gaskets 47. the assembly formed by the gaskets 45 and 47 is contained in an elliptical seat 48 engaged by a corresponding retaining gasket 51 which reproduces substantially the shape of the gasket 18. It should be noted that the seats 46 use part of the extension of the seat 44 and part of the extension of the seat 48. Respective antiextrusion gaskets 52 constructed preferably of a rigid material such as TEFLON are laid along the inside periphery of the respective retaining gaskets 45 and 47 along the seats 44 and 46. Five spaces 53, 54, 55, 56 and 57 are therefore defined on that face of the cover 3 which faces the diaphragm 5. The space 53 is delimited by the gasket 45, the spaces 54 and 55 oppose each other about the central part of the cover 3 and are delimited by the gaskets 47, and the spaces 56 and 57 oppose each other about the centrl part of the cover 3 and are delimited by a portion of the gasket 45, 47 and a portion of the gasket 51. As will be apparent hereinafter, the space 53 for hydraulic communication with the holes 31 is in a zone through which low-pressure fluid passes, as is evident from the fact that for motor operation the space 53 is connected to discharge through the bore 43. By way of the holes 36*a*, the spaces 54 and 55 are in hydraulic communication with the cavity 12 in the low pressure zone and with the cavity 12 in the high pressure zone, according to the direction of rotation of the shafts 7. In operation as a pump, the hole 36*a* communicating with the cavity 12 in the low pressure zone is shown by a dashed line (FIG. 3) and indicated by 61. It has a diameter greater than the other holes 36*a* and 36*b*. In operation as a pump, to facilitate drainage of the fluid which seeps along the holes 13 in the bushes 8 and its recycling to the suction side, within the space 55 or 54 there is provided an oblique bore 62 (shown by dashed lines in FIGS. 1 and 2) which connects the hole 61 to the intersection of the holes 42. Finally, it should be noted that for essential drainage purposes, an axial through bore 64 shown by dashed lines in FIG. 1 is provided in the shorter shaft 7. If the machine is operated as a motor and is series-connected so that the fluid is not fed to discharge but to a further user device, the spaces 54 and 55 are simultaneously in a high-pressure zone. The spaces 56 and 57 are connected by the holes 36*b* to a high-pressure zone defined within the machine casing 2.

Figure 4:
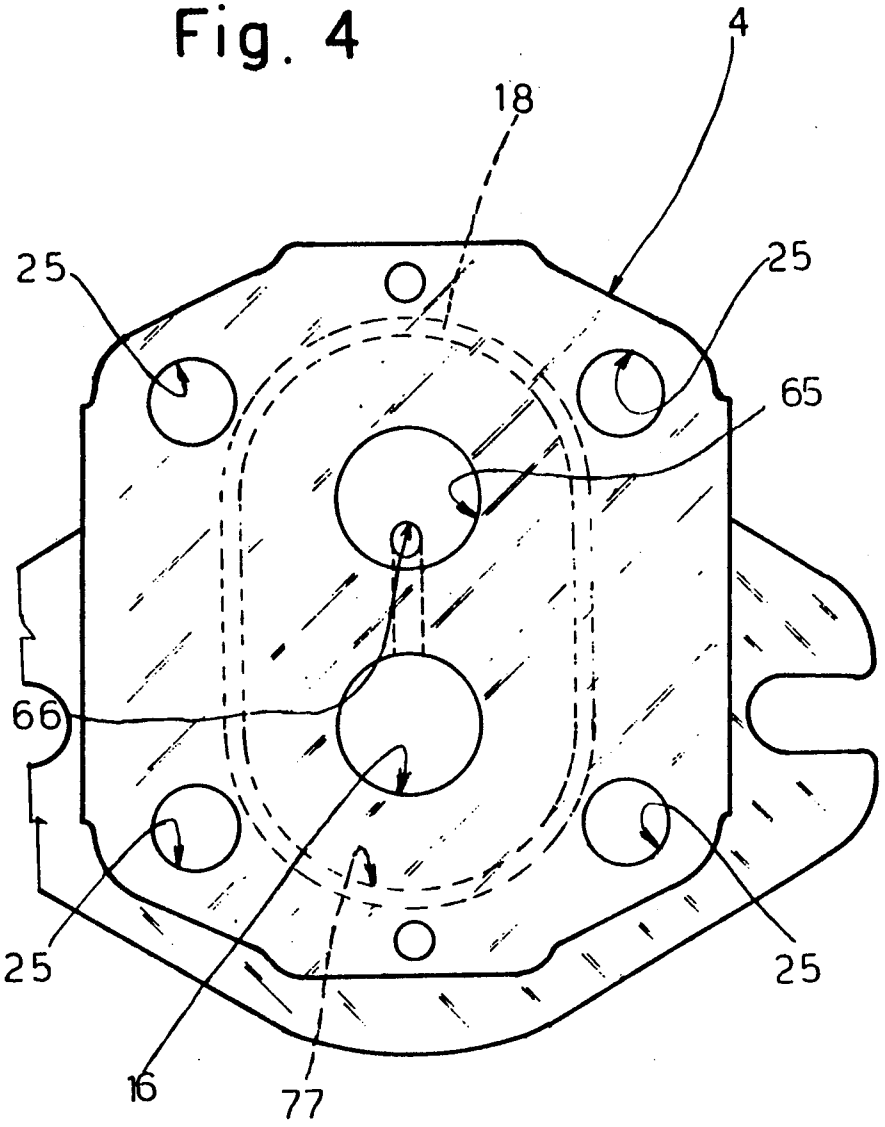

As shown in FIGS. 1 and 4, on that face of the cover 4 facing the machine casing 2 there is a recess 65 coaxial with the shorter shaft 7. The recess 65 is in hydraulic communication with a seal assembly 67 by way of an oblique bore 66. When in operation, the effect of the fluid pressure between the cover 4 and the adjacent bush 8 mechanically determines a hydraulic seal. For operation as a motor, a pressurised fluid enters the machine casing 2 through one port 11 to rotate the gear wheels 6 and convert hydraulic energy to mechanical energy. The fluid is then discharged at a lower pressure through the other port 11. Any fluid which seeps along the holes 13 in the bushes 8 and specifically between the liners 14 and the wall of the holes 13 is drained to the outside through the bore 43. In this respect, the fluid which seeps along that bush 8 adjacent to the cover 3 flows out towards the recesses 41, which mutually communicate via holes 42 and one of which is provided along the bore 43. The fluid which seeps along the other bush 8 flows out towards the recess 65 and also along the bore 16, and from this latter through the bore 66 to the recess 65. From this latter the fluid flows towards the bore 43 passing through the bore 64, the hole 31 and the recess 41 in succession. Both for motor and for pump operation the holes 36*b* communicate with the maximum pressure zone, which is that relative to those teeth of the gear wheel 6 distant from the engaging teeth. At the commencement of operation there is a gap between the clearance walls defined by the faces of the teeth of the gear wheel 6 and the corresponding faces of the bushes 8 because temporarily unbalanced axial thrusts act on those faces of the bushes 8. The bushes 8 therfore move towards the respective covers 3 and 4, resulting in absence of friction between the gear wheels 6 and bushes 8. Consequently the gear wheels 6 immediately begin to rotate even if the pressure of the fluid fed into the casing 2 is low. At this stage the volumetric efficiency is low because a certain quantity of fluid seeps along said clearance walls without performing any work on the gear wheels 6. The seal assembly contained between the cover 3 and diaphragm 5 comprises gaskets which, because they are of greater thickness than the seat which houses them, become preloaded on assembly. The thrust exerted by these gaskets is absorbed by the diaphragm and is insufficient to flex the diaphragm 5. Thus on starting, the gasket preloading does not affect the clearance between the bush 8 and gear wheels 6 and therefore does not influence the mechanical efficiency, which remains high. In the meantime a quantity of the fluid fed into the casing 2 occupies the spaces 56 and 57 and one of the spaces 54 or 55 defined between the cover 3 and diaphragm 5. The total contact area between the cover 3 and diaphragm 5 in which high-pressure fluid is present is large and substantially equal to that area of the bush 8 over which said axial thrusts are developed. The motor operation is of the fixed clearance type on starting, but with increasing pressure the diaphragm 5 flexes to an extent dependent on the pressure and on the size of the compensation area between the cover 3 and diaphragm 5. As the diaphragm 5 flexes it takes up the gap along the clearance walls. This gap is not totally taken up because part of the compensation pressure is used in overcoming the reaction produced by the flexure of the diaphragm 5. Summarizing, a machine is provided in which the compensation system, necessary for obtaining high volumetric efficiency, does not finalize mechanical efficiency, to thus ensure the highest overall efficiency. In particular, at very low speed the high mechanical efficiency obtained by virtue of the low friction force along the clearance walls is vital in enabling the machine to start if there is a high resistant torque on the shaft 7.

It is apparent that by using the machine 1 it is not necessary to overdimension the pump upstream of the motor as this, when under full running conditions, has substantially the same mechanical efficiency as a compensation motor. Obviously, a diaphragm similar to the diaphragm 5 can also be installed between the cover 4 and the machine casing 2. Again in this case, partial take-up of the gap at the bush 8 will occur when the fluid flexes the diaphragm 5.

For pump operation, one port 11 is connected to a fluid tank and the other port 11 is connected to a user device. On connecting the shaft 7 extending outside the machine 1 to the shaft of, a for example, an electric motor, the mechanical energy of the motor shaft is converted into hydraulic energy in that the gear wheels 6 draw liquid from the tank and deliver it to the user device. It should be noted that as the liquid is delivered to the user device the pressure increases at the outlet port and in all those spaces communicating with it either by virtue of seepage along the bushes 8 and casing 2 as described heretofore or through the channel provided at the outlet port 11. It should also be noted that in contrast to motor operation, in which drainage is to the outside so as not to compromise the seal assembly 67, in pump operation the drainage fluid can be conveniently recycled by feeding this drainage fluid to said the channel defined at the inlet port 11. For pump operation the bore 43 is therefore closed, and to improve drainage the bore 62 is provided and the hole **36*a* communicating with the inlet port 11 is enlarged (as indicated by 61 in FIG. 3**).

When operating as a pump, there is again a gap along the clearance walls on starting, and this substantially reduces the friction which the electric motor must overcome for initial separation. As the pressure gradually increases, the diaphragm 5 flexes to partially close the gap and partially compensate for axial thrusts, to obtain a volumetric efficiency substantially higher than the initial value. Thus on starting, the pump behaves as a fixed clearance pump with all its associated advantages, whereas as pressure increases it behaves as a compensated pump with all the advantages deriving therefrom. It must be emphasized that the use of the machine 1 obviates the need to use a powerful motor to overcome initial separation friction as is required for balanced pumps of the prior art. At high pressure, the pump volumetric efficiency is greater than that of fixed clearance pumps of the prior art. For pump operation, a second diaphragm 5 can also be installed as described with reference to operation as a motor. It should be noted that although the machine 1 comprises one extra component, it is of reduced manufacturing cost as no precision finishing machining is required to define the clearance along the clearance walls and the preload applied the gaskets on tightening-down during assembly. In addition the use of the machine 1 as described results in a saving in the members installed upstream or downstream thereof.

Finally, it is apparent that modifications can be made to the described and illustrated machine 1, but without departing from the scope of the present invention.

In particular, a respective diaphragm 5 of convenient material and thickness in relation to the flexing pressure can be connected to each cover 3 and 4. In addition, it is apparent that the machine 1 is reversible, i.e., can operate with the gear wheels 6 rotating in either direction at the option of the user.

What is claimed is:

1. A gear machine comprising:

a substantially cylindrical casing having first and second end faces;

a first cover mounted on said casing and opposing said first end face;

a second cover mounted on said casing and opposing said second end face;

a diaphragm arranged between said first cover and said first end face of said casing, said diaphragm contacting said first end face along its entire periphery;

first and second bushes mounted inside said casing and between said second cover and said diaphragm, said first bush being adjacent to said diaphragm and said second bush being adjacent to said second cover, each of said first and second bushes having first and second end faces;

a first shaft rotatably supported by said first and second bushes at first and second relatively axially displaced portions thereof;

a second shaft rotatably supported by said first and second bushes at first and second relatively axially displaced portion thereof and having a third portion which extends outside said casing;

a first gear wheel mounted on said first shaft and having first and second end faces;

a second gear wheel mounted on said second shaft and having first and second end faces, said first and second gear wheels being in mutual engagement; and means for exerting a pressure on said diaphragm in excess of a predetermined threshold pressure for urging said diaphragm against said first end face of said first bush, wherein said first bush is arranged such that upon start-up of said gear machine its second end face is separated from said first end faces of said first and second gear wheels by a first clearance, a central portion of said diaphragm does not move said first bush toward said first and second gear wheels during a start-up period of said gear machine, and said central portion of said diaphragm flexes and correspondingly moves said first bush toward said first and second gear wheels in response to urging by said pressure exerting means to narrow the distance therebetween to a second clearance less than said first clearance after said start-up period of said gear machine.

2. The gear machine as defined in claim 1, wherein said pressure exerting means comprises means for channeling a flow of fluid from a first space occupied in part by said gear wheels to a second spaced located between said diaphragm and said first cover.

3. A gear machine for use as a pump or motor of the type comprising a machine casing (2) respectively closed at first and second axial ends by first and second covers (3 and 4) and internally housing first and second mutually engaging gear wheels (6) respectively provided on first and second rotatable shafts (7) which are supported by first and second bushes, said first shaft extending to the outside of said machine casing, said first bush being axially separated from an end face of said gear wheels by a first clearance, wherein betweeen said first cover and an end face of said machine casing there is installed a relatively elastic diaphragm (5) in which there is provided aperture means for providing a first hydraulic communication (36*a* and 36*b*) between a zone of said machine casing traversed by a high-pressure fluid and a first space (56, 57, and 54 or 55) delimited between said first cover and said diaphragm by a first preloaded gasket assembly (45, 47 and 51) and having an area substantially equal to that defined area on said bushes on which axial thrusts are present during operation, and for providing a second hydraulic communication (31 or 36*a*) between a zone of said machine casing traversed by low-pressure fluid and a second space (53, 55 or 54) delimited between said first cover and said diaphragm by a second gasket assembly (45 and 47); the preload of said first gasket assembly being insufficient to cause flexure of said diaphragm at the start of operation and thus unable to change said first clearance existing between said first bush and said gear wheels so that rapid starting is ensured even under load, whereas as fluid pressure increases beyond a predetermined threshold, the fluid present in said first space causes corresponding flexure of said diaphragm towards said first bush so as to gradually narrow the distance between said first bush and said gear wheels to a second clearance less than said first clearance.

4. A gear machine as claimed in claim 1, wherein said diaphragm is made of aluminum.

5. A gear machine as claimed in claim 3, wherein said aperture means for providing the hydraulic communication between said high pressure zone and a first part (56 or 57) or said first space is effected by first and second through holes (36*b*) provided in said diaphragm in line with a gap existing between said first bush and the inner wall of said machine casing.

6. A gear machine as claimed in claim 5, wherein said aperture means further comprises third and fourth through holes (36*a*), said third through hole being arranged to hydraulically connect a second part (54 or 55) of said first space to said high-pressure zone, and said fourth through hole being arranged to hydraulically connect a first part (55 or 54) of said second space to said high-pressure zone.

7. A gear machine as claimed in claim 6, wherein said first and second holes are in a position symmetrical about a straight line orthogonal to a straight line joining said third and fourth holes.

8. A gear machine as claimed in claim 7, wherein said aperture means further comprises fifth and sixth through holes (31) in the central part of said diaphragm and coaxial with respective holes (13) provided in said first bush to support said first and second shafts, said fifth and sixth holes (31) hydraulically connecting said low-pressure zone to a second part (53) of said second space by way of said holes in said first bush.

9. A gear machine as claimed in claim 8, wherein a respective notch (15) is provided longitudinally along each of said holes in said first bush to allow passage of that fluid which during operation seeps between said gear wheels and said first bush towards said second part of said second space.

10. A gear machine as claimed in claim 8 wherein said first bush comprises on opposite sides of its outer surface first and second cavities (12) which with the inner wall of said machine casing define respective first and second channels, said first channel being arranged to hydraulically connect said high-pressure zone to said second part of said first space by way of said third through hole and said second channel being arranged to hyraulically connect said low-pressure zone to said first part of said second space by way of said fourth hole.

11. A gear machine as claimed in claim 10, wherin said second part of said second space is delimited by a first gasket (45) having a perimetral shape similar to that of said first bush; and within said second part of said second space said first cover has first and second cylindrical recesses (41) which are coaxial with said firth and sixth through holes and communicate with each other by way of first and second bores (42) which extend from these recesses and intersect within said first cover.

12.A gear machine as claimed in claim 11, wherein said first part of said second space is delimited by a second gasket (47) having a perimetral shape substantially similar to but more extensive than said first cavity with which it is in hydraulic communication by way of said third through hole on said diaphragm.

13. A gear machine as claimed in claim 12, wherein said second part of said first space is delimited by a third gasket (47) having a perimetral shape substantially similar to but more extensive than said second cavity (12) with which it is in hydraulic communication by way of said fourth through holes in said diaphragm.

14. A gear machine as claimed in claim 13, wherein said first part of said first space is delimited externally by a fourth gasket (51) and internally by said first, second and thrid gaskets.

15. A gear machine as claimed in claim 14, wherein for operation as a motor, a discharge port (43) is provided which communicates with said first clyindrical recess to allow drainage to the outside.

16. A gear machine as claimed in claim 15, wherein for pump operation, said first cover is provided with a through hole (62) communicating with said third through hole in said diaphragm and opening into the intersection of said first and second bores.

* * * * *

UNITED STATES PATENT AND TRADEMARK OFFICE

CERTIFICATE OF CORRECTION

PATENT NO. : 5,004,412

DATED : April 2, 1991

INVENTOR(S) : Zanardi et al.

It is certified that error appears in the above-identified patent and that said Letters Patent is hereby corrected as shown below:

Title page, left column

Amend item [73] to read --Assignee:

Sauer - SUNDSTRAND S.P.A.

Villanova Di Castenaso, Italy--

Delete item [30]

Signed and Sealed this

Twenty-fourth Day of November, 1992

*Attest:*

DOUGLAS B. COMER

*Attesting Officer*

*Acting Commissioner of Patents and Trademarks*